US007448443B2

(12) United States Patent
Jones et al.

(10) Patent No.: US 7,448,443 B2
(45) **Date of Patent: *Nov. 11, 2008**

(54) VARIABLY OPERABLE OIL RECOVERY SYSTEM

(75) Inventors: Dan Jones, Valley Mills, TX (US); Devane Clark, Dallas, TX (US)

(73) Assignee: Epi-Energy, Ltd., Waco, TX (US)

( * ) Notice: Subject to any disclaimer, the term of this patent is extended or adjusted under 35 U.S.C. 154(b) by 56 days.

This patent is subject to a terminal disclaimer.

(21) Appl. No.: 11/284,798

(22) Filed: Nov. 22, 2005

(65) Prior Publication Data

US 2007/0116580 A1 May 24, 2007

(51) Int. Cl.
*E21B 43/12* (2006.01)

(52) U.S. Cl. ..... 166/68.5; 475/162

(58) Field of Classification Search ..... 166/72, 166/105, 68.5; 475/162, 165, 166, 168, 169, 475/170

See application file for complete search history.

(56) References Cited

U.S. PATENT DOCUMENTS

| | | | | |
|---|---|---|---|---|
| 81,329 | A | | 8/1868 | Barden |
| 107,432 | A | | 9/1870 | Zeigler |
| 850,597 | A | | 4/1907 | McCanna |
| 955,458 | A | | 4/1910 | Hampton |
| 1,141,626 | A | | 6/1915 | Granville |
| 1,270,950 | A | | 7/1918 | Johanson |
| 1,538,008 | A | | 5/1925 | Sharkey |
| 1,538,328 | A | | 5/1925 | Holdener |
| 1,770,016 | A | | 7/1930 | Rullanclch |
| 1,833,993 | A | | 12/1931 | Hill |
| 2,475,504 | A | | 7/1949 | Jackson |
| 3,037,400 | A | | 6/1962 | Sundt |
| 3,043,164 | A | | 7/1962 | Sundt |
| 3,668,947 | A | | 6/1972 | Waldorf |
| 4,099,427 | A | | 7/1978 | Fickelscher |
| 4,193,324 | A | | 3/1980 | Marc |
| 4,227,422 | A | | 10/1980 | Kawashima |
| 4,898,065 | A | * | 2/1990 | Ogata et al. ..... 475/179 |
| 4,909,102 | A | * | 3/1990 | Haga ..... 475/168 |
| 5,246,076 | A | * | 9/1993 | Watson ..... 166/369 |
| 5,292,289 | A | | 3/1994 | Ogata |

(Continued)

OTHER PUBLICATIONS

U.S. Appl. No. 10/869,303, filed Jun. 16, 2004, Jones.

(Continued)

*Primary Examiner*—David J. Bagnell
*Assistant Examiner*—Daniel P Stephenson
(74) *Attorney, Agent, or Firm*—Fulbright & Jaworski L.L.P.

(57) ABSTRACT

A variably operable oil recovery system having a variable motor and reducer in mechanical communication with one another where each shares a common axis of rotation. The reducer receives the drive on a high side where each has the same rotational speed, and the reducer maintains a spooled cable on its low side, which rotates at reduced speed and increased torque. The drive and reducer combination move between a first (forward) mode and a second (reverse) mode to alternatingly release and wind a spooled cable extending between the reducer low side and a below surface reciprocating pump. The system is further characterized by an electronic component combination that can continuously manage operational parameters such as stroke length, stroke speed, and power consumption.

4 Claims, 5 Drawing Sheets

U.S. PATENT DOCUMENTS

| | | | | |
|---|---|---|---|---|
| 5,324,240 | A | 6/1994 | Guttinger | |
| 5,655,985 | A * | 8/1997 | Herstek | 475/179 |
| 5,697,868 | A | 12/1997 | Akeel | |
| 6,220,115 | B1 | 4/2001 | Hirn | |
| 6,280,359 | B1 | 8/2001 | Moskob | |
| 6,336,881 | B1 | 1/2002 | Rapp | |
| 6,416,438 | B1 * | 7/2002 | Choi et al. | 475/170 |
| 6,428,437 | B1 | 8/2002 | Schlanger | |
| 6,453,772 | B1 | 9/2002 | Moskob | |
| 6,490,941 | B1 | 12/2002 | Hur | |
| 7,192,375 | B2 * | 3/2007 | Jones | 475/179 |
| 7,199,497 | B2 * | 4/2007 | Tessier et al. | 310/90 |
| 2004/0099417 | A1 * | 5/2004 | Holcomb et al. | 166/311 |
| 2004/0198543 | A1 * | 10/2004 | Christ | 475/163 |

OTHER PUBLICATIONS

U.S. Appl. No. 10/945,529, filed Sep. 20, 2004, Jones.
U.S. Appl. No. 10/963,104, filed Oct. 12, 2004, Jones.
U.S. Appl. No. 11/263,097, filed Nov. 22, 2005, Jones.
Sumitomo Machinery Corporation of America, A Unique Concept in Speed REducers & Gearmotors, 2002, United States.

* cited by examiner

VARIABLY OPERABLE OIL RECOVERY SYSTEM

BACKGROUND OF THE INVENTION

1. Field of the Invention

The present invention generally relates to an oil recovery system. More specifically, the present invention relates to an oil recovery system where a below surface reciprocating pump is actuated by a variably operable motor and reducer combination alternating between a first and second mode.

2. Background Information

No doubt there have been countless devices and methods developed over the years for improving the efficiency of oil recovery. While these devices may fulfill their respective, particularly claimed objectives and requirements, the aforementioned devices and methods do not disclose a variably operable oil recovery system such as Applicant's present invention. Indeed, it is well known to those skilled in the art that the oil recovery industry is filled with an endless variety of devices and methods all having a common objective—the improved recovery of oil.

Nevertheless, known oil recovery devices and methods are subject to constraints that are avoided by Applicant's invention. For instance, a standard "pump jack" may be effective for systematic reciprocation of a sucker rod; however, such a recovery mechanism is subject to limitations overcome by Applicant's invention. That is, a pump jack operates at a fixed speed, on a fixed amount of power, with a fixed stroke length, and with fixed (and relatively limited) operating efficiency. A typical surface recovery unit, such as a "Pumpjack," is mechanically inefficient and unattractive. Such units rely on gears and sliding parts, which are subject to tremendous strain and friction, are large and awkward, and are of an environmentally unfriendly nature.

Commonly, underground fluid recovery systems are hindered by mechanically inefficient operation. These inefficiencies are primarily a result of sliding part friction among components and resulting wear and tear of those components. Perhaps the single greatest source of efficiency loss is the standard gearbox used in combination with a Pumpjack. Typically, these gearboxes are driven by an electronic motor and have a "crank arm" extending to support a counterweight. The gearbox configuration is such that its rotation actuates the crank arm and the counterweight attached thereto between a top and bottom position. The gearbox is in combination with the Pumpjack itself though some connecting rod, so that as the crank arm, extending from the gearbox, actuates between a top and bottom position, the Pumpjack actuates accordingly in one-to-one fashion. As a result of this configuration, gearboxes associated with standard Pumpjack operation are subject to tremendous stress. Eventually, these stresses wear down the gears within the gearbox. Once these gears wear down, a system breakdown is not far behind.

Another glaring problem associated with typical surface recovery devices is their relatively large and unavoidably cumbersome arrangement. Even the smallest pumpjacks assume a relatively large footprint, and these recovery devices are unsightly and environmentally unfriendly. During operation, their moving parts are hazardous to anyone performing repairs or simply coming within their proximity.

As a result of typical surface pumps being loud, cumbersome, visually offensive, dangerous, and environmentally unfriendly, restrictions are placed on both where and when these systems can be used. Prohibitive zoning restrictions are often based on the way the pumps look, how they sound, and the inconvenience they cause to people in their proximity.

Further, it is widely known to those skilled in the art that conventional surface pumps are prone to leaking oil and hazardous fumes. As such, environmental concerns are very high and periodic maintenance is required, all the while, cost of operation increases while efficiency decreases. Surface pumps are also dangerous; all to often injury or even death results from the operation of such pumps. These casualties often involve children who make their way to the pumps, drawn by curiosity, only to get caught in the moving parts.

SUMMARY OF THE INVENTION

In view of the foregoing, it is an object of the present invention to provide a variably operable oil recovery system that is extremely mechanically efficient.

It is another object of the present invention to provide a variably operable oil recovery system that is very compact.

It is another object of the present invention to provide a variably operable oil recovery system that is extremely durable.

It is another object of the present invention to provide a variably operable oil recovery system that can withstand extreme shock loads.

It is another object of the present invention to provide a variably operable oil recovery system that operates quietly.

It is another object of the present invention to provide a variably operable oil recovery system that is safe.

It is another object of the present invention to provide a variably operable oil recovery system that is visually pleasing.

It is another object of the present invention to provide a variably operable oil recovery system that is environmentally friendly.

In satisfaction of these and other related objectives, the present invention provides an oil recovery system that overcomes problems associated with known recovery devices and methods. Applicant's invention involves a surface recovery unit that operates with tremendous mechanical efficiency. Further, the surface recovery unit can operate at a variable torque, a variable stroke length, and a variable power input. In its most preferred form, the present surface unit may be sealed both with respect to the casing annulus and its surrounding environment. As such, environment hazards are greatly reduced. Finally, the present system provides for a surface recovery unit that is much smaller than known recovery devices; in fact, the surface recovery unit is capable of being placed just below the surface in some instances.

The preferred embodiment of the present invention incorporates an input shaft with dually eccentric lobes driven by a variably operable drive member. Each lobe is offset from the input shaft center an equal distance but in diametrically opposing directions. A driver disc surrounds each eccentric, or offset lobe so spaced as to allow low-friction, rolling engagement between the eccentric lobe and the driver disc. By operation of the camshaft configuration (input shaft/eccentric lobe combination), as the input shaft rotates in a given direction, each driver disc is "pushed" outward against another low-friction, rolling mechanism embedded within the housing circumferentially about the outer diameter of the driver discs themselves. As each driver disc engages this outer rolling mechanism, each driver disc is forced to rotate about its respective center in the opposite direction of the input shaft. At the same time, each driver disc is forced to revolve about the input shaft in the same direction as the input shaft but at reduced speed and corresponding increased torque. This torque is transferred to an output member via a final low-friction, rolling engagement. This output member maintains a spooled cable, which extends to a downhole location where it drives a pumping means via the drive member alternating between a forward and a reverse mode resulting in actuation of the cable between a retracted and extended position. Flow from the oil recovery system is forced, by the pumping means, through a production tube, wherein a flow measurement means is incorporated. The flow measurement means, in turn, is monitored by a controller means, which controls the actuation of the variable drive member to optimize the operation of the variably operable oil recovery system.

Because of the make-up and configuration of the component parts of the torque variation member, an extremely efficient torque increase may be transferred in a much more compact package than traditional systems. The torque increase in a traditional system is dependent on the relative diameters and alignment of each gear within the system. Since the outer diameters (gear teeth) must mate in order to transfer torque, the envelope within which the system can be placed is quite broad. In contrast, torque increase delivered by the present invention is dependent upon the amount of eccentricity and the radius of the driver discs in relation to the position of the members which transfer torque from the driver discs to the output member. Moreover, since this entire envelope is equal to the diameter of the driver disc plus twice the eccentricity, the device of the present invention is much more compact than that of traditional oil recovery systems.

Additionally, the mechanical efficiency of the present invention is extremely high because of the near elimination of friction within the system as compared to traditional oil recovery systems. Because traditional systems depend on the engagement of turning gear teeth, a significant amount of efficiency is lost due to the "sliding" friction generated between the mating teeth. However, all torque transfer in the present system is accomplished through low-friction, rolling engagement; therefore, because the present invention completely eliminates the "sliding" friction effect of traditional systems, it is able to operate at a significantly higher efficiency than traditional oil recovery systems.

The present invention is also able to withstand much higher loading (including shock loading) than traditional oil recovery systems. In traditional systems, all loading is transferred between a single tooth of one gear mating with a single tooth of another gear; thus, at any given time all of the loading in the system is concentrated on a single gear tooth. In the present invention, loading is evenly distributed among multiple, rolling members, which, in turn, allows the system to withstand much higher loading than its traditional counterpart. Not only does this relate to a more robust system (compared to size), but it also results in a more reliable system because damage to one rolling member does not result in total system failure whereas a broken gear tooth does lead to total system failure. Therefore, the present design is much more durable and reliable than traditional oil recovery systems currently well known in the art.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENT

Figure 1:
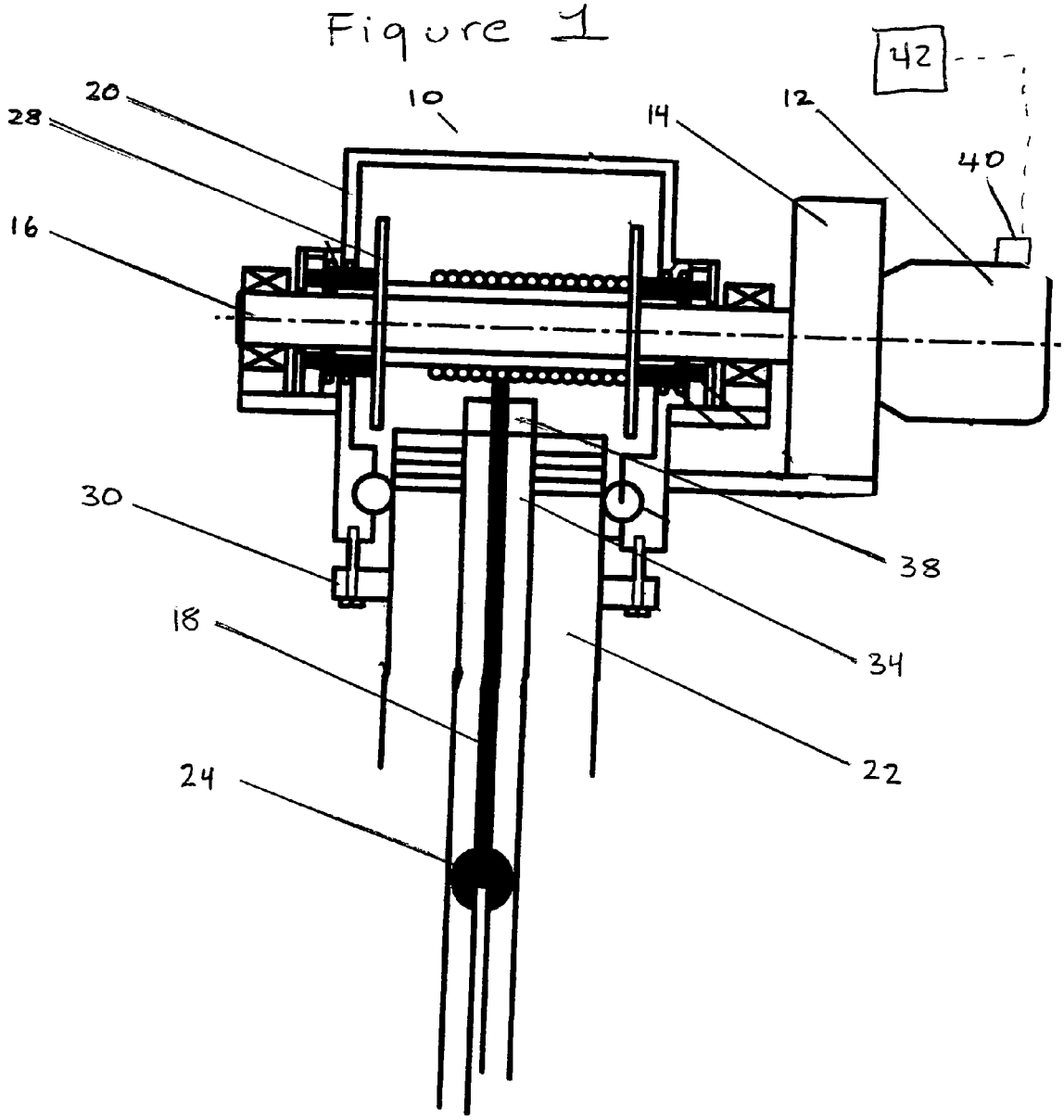
FIG. 1 is a front plan view of the system of the preferred embodiment of the present invention.

Referring to FIG. 1, the system of the present invention is generally designated by the reference numeral 10. System 10 is thought to be most beneficial in the context of oil recovery, and as will be further discussed, is thought to be particularly beneficial for such in view of its advantages with respect to smaller size, mechanical efficiency, outstanding gear reduction and torque variation characteristics, and the ability withstand sheer or shock loads—all of which result from its novel configuration.

System 10 is characterized by drive member 12 in combination with torque variation member 14. In the preferred embodiment, drive member 12 is an electronically controlled member capable of variable operation. More specifically, drive member 12 may operate at different speeds and in different modes (i.e., forward mode and reverse mode). A variety of drive members may be sufficient, if not useful, in the present system. However, in the preferred embodiment, drive member 12 is a high horsepower motor often referred to as a switched reluctance drive motor, or "S R DRIVE" motor. Such are manufactured by Switched Reluctance Drives Ltd., of the United Kingdom; and, manufactured under license by LeTOURNEAU, INC. of Longview, Tex. Other useful motors are thought to be similar models known to be manufactured by SIEMANS and MOOG, INC. These drives are held out as being particularly useful in that they are capable of operating at variable speeds and can repeatedly switch between forward and reverse operating mode in seamless fashion. That is, they are not mechanically "bothered" by variable operation.

Drive member 12 is in mechanical communication with torque variation member 14 where each shares a common axis of rotation. A novel aspect of the present system is found in the application of drive member 12 and torque variation member 14 in the present context. As will be further discussed, drive member 12 and torque variation member 14, alone and in combination with one another, establish several novel attributes of the present system. Most importantly, these components provide for improved mechanical efficiency of the present system and allow such to be achieved in a relatively small framework.

Torque variation member 14 is engaged with drive member 12 at a high side where each shares the same rotational speed. Torque variation member 14 has a low side that rotates at reduced speed, albeit with increased torque. Shaft member 16 extends from the low side of torque variation member 14 and rotates at the reduced speed and increased torque of torque variation member 14 low side. Importantly, torque variation member 14 is particularly advantageous when used in the present system. Torque variation member 14 has outstanding capabilities with respect to mechanical efficiency, the ability to withstand sheer or "shock" loads, variable speed reduction, and variable torque increase between its high side and low side.

Figure 4:
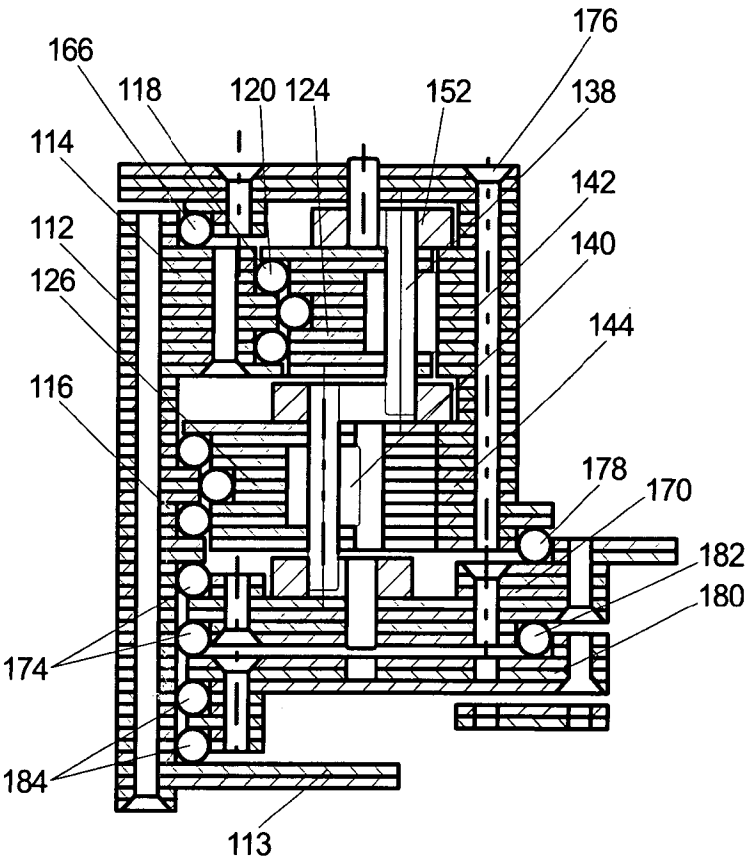
FIG. 4 is a cross section view of the torque variation member of preferred embodiment of the present invention.
Figure 4:
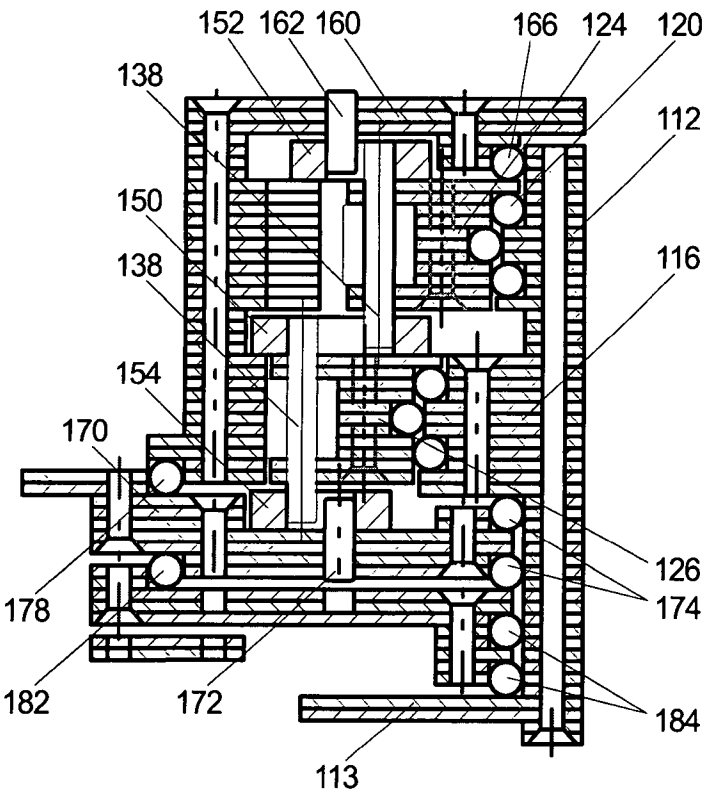

Referring to FIG. 4, torque variation member 14 can engage with drive member 12 at flange 113. Torque variation member 14 may engage with motor 12 at flange 113 by any number of common securing means, such as a weld, or series of bolts or screws. Flange 113 and central component 112 are fixed with respect to one another and rotate with the same velocity. Further, the combination of central component 112 and flange 113 serve as an input component driven by drive member 12. As the external driving force, drive member 12, causes flange 113 to rotate, central component 112 rotates with the same velocity.

Central component 112 is further characterized by a pair of eccentric lobes, eccentric lobe 114 and eccentric lobe 116. Each lobe is axially aligned with central component 112, but centrally offset therefrom. Specifically, eccentric lobes 114 and 116 are configured so that eccentric lobe 114 is offset from central component 112 in one direction, and eccentric lobe 116 is offset from central component 112 by the same amount, in the diametrically opposite direction. Central component 112, in combination with eccentric lobes 114 and 116 form the generic shape of a camshaft. In the preferred embodiment, central component 112 contains only two eccentric lobes. However, other embodiments of the present invention are envisioned where three or more eccentric lobes are configured with respect to central component 112 to allow multiple stage reductions between input and output rotation velocity. Because speed reduction occurs by operation of stacked plates eccentrically engaging an output disc, multiple reductions can be achieved without a substantial increase in size of the device.

Again referring to FIG. 4, eccentric lobe 114 and eccentric lobe 116 each contain eccentric lobe bearing grooves 118. Eccentric lobe bearing grooves 118 are sized to allow eccentric lobe bearings 120 to remain embedded along the outer circumference of eccentric lobes 114 and 116, and freely rotate within eccentric lobe bearing grooves 118. As mentioned, other embodiments are envisioned where central component 112 contains three or more eccentric lobes, which would allow for three or more sets of eccentric lobe bearing grooves 118. Again, such embodiments are thought to be particularly useful for multiple-speed reductions between the input and the output.

Referring principally to FIG. 4, driver disc 124 and driver disc 126 are of a general circular disc shape, and surround central component 112 whereby driver disc 124 is aligned with eccentric lobe 114, and driver disc 126 is aligned with eccentric lobe 116. Driver disc 124 and driver disc 126 are spaced from eccentric lobe 114 and eccentric lobe 116, respectively, such that eccentric lobe bearings 120, seated in eccentric lobe bearing grooves 118, fit between each driver disc and each eccentric lobe. Eccentric lobe bearings 120 allow central component 112 to rotate within each driver disc, while each driver disc remains centrally aligned with respect to its corresponding eccentric lobe. Along their outer circumference, driver disc 124 and driver disc 126 receive output ring 142 and output ring 144, respectively, and are engaged with such through an engagement means where a dowel and pin combination spaced along the periphery of each driver discs alternatingly engages a series of grooves spaced along each output ring.

As central component 112 rotates, and variable member 170 is held fixed with respect to the surrounding environment, each driver disc sweeps out eccentric circles having a radius equal to the sum of the radius of the disc, the radius of central component 112, and the eccentricity of the corresponding lobe. As driver disc 124 and driver disc 126 rotate about central shaft 112 in eccentric fashion, each engages output ring 142 and output ring 144, respectively, at diametrically opposite points. By virtue of the eccentric rotation of driver disc 124 and driver disc 126, each engages and "pushes" output ring 142 and output ring 144, respectively, in the same rotational direction as central component 112, albeit at a reduced rotational velocity. Importantly, each output disc remains axially, centrally fixed with respect to central component 112 during operation.

Figure 5:
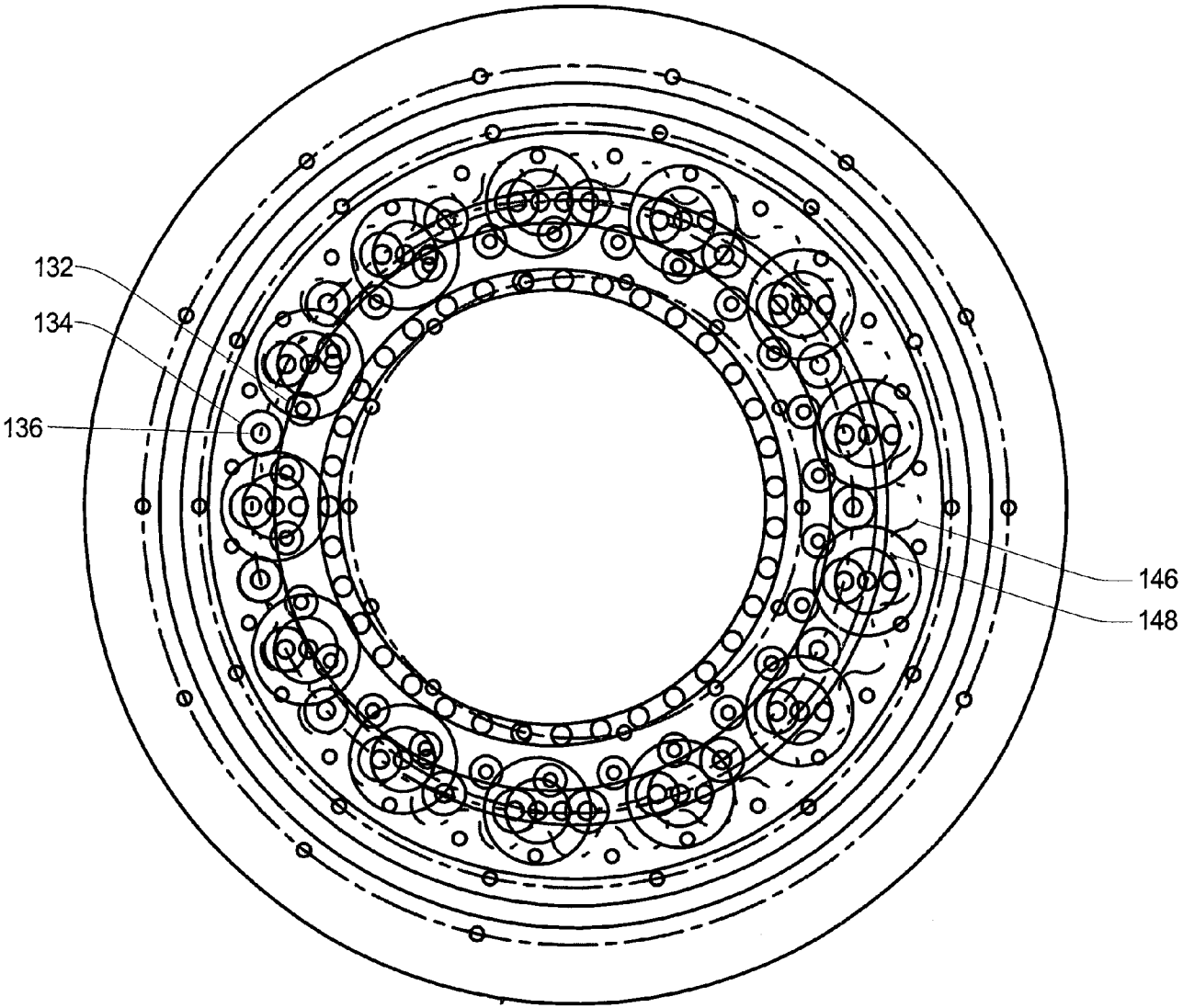
FIG. 5 is a top view of the torque variation member of the preferred embodiment of the present invention.

As shown in FIG. 5, each driver disc consists of a series of semicircular grooves 132 and protrusions 134 uniformly spaced along each driver disc outer circumference. Grooves 132 and protrusions 134 are alternatingly arranged around each disc in groove-protrusion, groove protrusion fashion. Semicircular protrusions 134 further contain protrusion apertures 136, through which dowels 138 are inserted. Referring to FIG. 4, dowels 138 serve to centrally align rollers 140 and protrusions 134. Rollers 140 are fitted between protrusions 134, and are held in alignment with protrusion 134 as they rotate about dowel 138. There are several advantages associated with using rollers 140. For instance, during operation, several rollers 140 are simultaneously in contact with the output disc. As such, sheer strength of the entire device is increased as any such sheer or "shock" force would be distributed evenly among all of the rollers in contact with output rings 142 and 144. Moreover, by virtue of the sinusoidal configuration of the protrusions 134 and grooves 132, and the "sweeping motion" of the driver discs 124 and 126, each roller 140 undergoes minimal rotation during engagement with output rings 142 and 144. This reduces operating friction and increases working life of component pieces. Other useful alternative embodiments are thought to incorporate different means of engagement. For example, such could be a series of engagement dowels along driver disc 124 and driver disc 126 outer circumferences, embedded so that a half-circumference of each dowel is contained within each driver disc and the other half-circumference protrudes from the driver disc in half-circle fashion. Similar to the preferred embodiment, these engagement dowels engage or "grab" output rings 142 and 144 as the driver discs 124 and 126 rotate.

As best seen in FIG. 4, in the preferred embodiment, each roller 140 fits within protrusion 134 and is primarily responsible for reversibly engaging with output ring 142 and output ring 144. Output ring 142 and output ring 144 each contain, along their inner circumference, a series of uniformly spaced sinusoidal grooves 146 and protrusions 148. As best seen in FIG. 5, grooves 146 and protrusions 148 are alternatingly arranged around each disc in groove-protrusion, groove protrusion fashion and are configured so that grooves 148 reversibly engage with protrusions 134, and protrusions 148 reversibly engage with grooves 132.

In the preferred embodiment, referring to FIG. 4, driver disc 124 and driver disc 126 interface with one another through a series of radially aligned inner rings 150. Each inner ring 150 is effectively sandwiched between driver disc 124 and driver disc 126, and is positioned to receive one dowel 138 from each driver disc member. Inner ring 150 receives dowels 138 such that a dowel 138 from driver disc 124 and driver disc 126 are contained within inner ring 150, at diametrically opposite positions. As driver discs 124 and 126 undergo their eccentric motion, each dowel 138 rolls along the inner circumference of inner ring 150. As such, driver disc 124 and driver disc 126 rotate in constant relation to one another and are engaged with one another in a low-friction environment. In the preferred embodiment, the diameter of each ring 150 is equal to the diameter of a dowel 138 and twice the lobe eccentricity. Such an arrangement allows for each driver disc to rotate about the central member in eccentric fashion, while having their respective center points offset by twice the lobe eccentricity, and remain engaged with one another. In the preferred embodiment, there is only one set of inner rings 150; however, other embodiments are envisioned where two or more sets of inner rings 150 are sandwiched between three or more driver discs. Moreover, in the preferred embodiment, the inner circumference of inner ring 150 is grooved, and the distal portions of dowel 138 are ball-shaped. As best seen in FIG. 4, this configuration allows discs 124 and 126 to rotate, on either side of inner ring 150, without surface contact between the components. Rather, dowel 138 fits within the groove of inner ring 150 so as to prevent any surface-to-surface friction among driver disc 124, driver disc 126, and inner ring 150.

In an alternative embodiment, driver disc 124 and driver disc 126 may interface through different means. For example, other embodiments are envisioned where driver disc 124 and driver disc 126 each contain inner bearing slots, to receive and hold a series of radially aligned bearings. Approximately one half of each bearing would be contained within each driver disc. As each driver disc contains one-half of each bearing therein, each driver disc is engaged with the other in a low-friction environment. In such case, the diameter of each bearing slot is equal to the diameter of each bearing and twice the eccentricity of central component 112. Such an arrangement allows for each driver disc to rotate about central component 112 in eccentric fashion, while having their respective center points offset by twice the eccentricity of each lobe, and remain engaged with one another.

Referring again to FIG. 4, driver disc 124 interfaces with output surface 160 through a series of radially aligned top rings 152. Each top ring 152 is effectively sandwiched between driver disc 124 and surface 160, and is positioned to receive a dowel 138 from driver disc 124 and a output surface dowel 162 from output surface 160. Each top ring 152 receives a dowel 138 and an output surface dowel 162 such that each is contained within each top ring 152, at diametrically opposite positions. As driver disc 124 undergoes its eccentric motion, each dowel 138 and output surface dowel 162 rolls along the inner circumference of top ring 152. In the preferred embodiment, the diameter of each top ring 152 is equal to the diameter of a dowel 138 and the lobe eccentricity. Such an arrangement allows for driver disc 124 to rotate about central component 112 in eccentric fashion, while having its respective center points offset by the lobe eccentricity, and remain engaged with output surface 160. In the preferred embodiment, the inner circumference of top ring 152 is grooved, and the distal portions of dowel 138 and output surface dowel 162 are ball-shaped. As best seen in FIG. 4, this configuration allows discs 124 to rotate without surface contact between components. Rather, dowel 138 and output surface dowel 162 fit within the groove of top ring 152 so as to prevent any surface-to-surface friction among driver disc 124, output surface 160, and top ring 152. Other useful embodiments are envisioned where driver disc 124 contains top bearing slots to receive a series of radially aligned top bearings, such that one half of the diameter of the top bearings are contained within driver disc 124, and the other half of the top bearings are contained in corresponding top surface plate bearing slots. These bearing slots are of half-spherical form, and have a diameter equal to the diameter of the top bearings and the eccentricity of eccentric lobe 114. This arrangement would also allow driver disc 124 to rotate about central component 112 in eccentric fashion, while remaining engaged with output surface 160.

Referring to FIG. 4, output surface 160 serves as an output component for member 14 as it rotates with reduced speed and increased torque with respect to central component 112. Further, output surface 160 is centrally aligned with central component 112. Output surface 160 is supported by its engagement with top rings 152 through output surface dowels 162, and output surface bearings 166, positioned between central component 112 and output surface 160. In the preferred embodiment, output surface 160 is of general circular disc shape and is configured for engaging with shaft member 16 (best seen in FIG. 1). Specifically, in the preferred embodiment, output surface 160 may contain an engagement means consisting of a series of radially aligned pins, extending perpendicularly from output surface 160, upon which shaft member 16 may slideably engage. Other useful embodiments are envisioned where shaft member 16 may simply be welded to surface 160 or engaged by any number of means known in the art. As a result, as output rings 142 and 144, and output surface 160 rotate with reduced speed and increased torque, so does shaft member 16.

Referring to FIG. 4, output surface 160 further contains a series of radially aligned fastening means 176, inserted through output surface 160, output ring 142, and output ring 144. Fastening means 176 holds output surface 160, output ring 142, and output ring 144 in radial alignment with one another. Accordingly, output surface 160 and output rings 142 and 144 all share the same rotational velocity. In the preferred embodiment, fastening means 176 may be pins, screws, or any suitable mechanism to align said output surface 160 and hold it centrally, axially fixed with respect to output ring 142 and output ring 144.

Referring again to FIG. 4, driver disc 126 interfaces with variable member 170 through a series of radially aligned rings 154. Each ring 154 is effectively sandwiched between driver disc 126 and variable member 170, and is positioned to receive a dowel 138 from driver disc 126 and a variable member dowel 172 from variable member 170. Each ring 154 receives a dowel 138 and a variable member dowel 172 such that each is contained within each ring 154, at diametrically opposite positions. As driver disc 126 undergoes its eccentric motion, each dowel 138 and variable member dowel 172 rolls along the inner circumference of ring 154. In the preferred embodiment, the diameter of each ring 154 is equal to the diameter of a dowel 138 and the lobe eccentricity. Such an arrangement allows for driver disc 126 to rotate about central component 112 in eccentric fashion, while having its respective center points offset by the lobe eccentricity, and remain engaged with variable member 170. In the preferred embodiment, the inner circumference of ring 154 is grooved, and the distal portions of dowel 138 and variable member dowel 172 are ball-shaped. As best seen in FIG. 4, this configuration allows driver disc 126 to rotate without surface contact between components. Rather, dowel 138 and variable member dowel 172 fit within the groove of ring 154 so as to prevent any surface-to-surface friction among driver disc 126, variable member 170, and ring 154.

Other useful embodiments are envisioned where driver disc 126 contains bottom bearing slots to receive a series of radially aligned bottom bearings, such that one half of the diameter of the top bearings are contained within driver disc 126 and the other half of the top bearings are contained in corresponding variable member bearing slots. These bearing slots are of half-spherical form, and have a diameter equal to the diameter of the bottom bearings and the eccentricity of eccentric lobe 114. This arrangement would also allow driver disc 126 to rotate about central component 112 in eccentric fashion, while remaining engaged with variable member 170.

Variable member 170 is engaged with central component 112 through bearings 174, and is engaged with output ring 144 through bearings 178. Configuration of bearings 174 and 178 allow variable member 170 to freely rotate with respect to central component 112 and output ring 144. If variable member 170 is not restrained, but allowed to freely rotate with central component 112. Each component (other than ground member 180) is allowed to rotate with central component 112 in one-to-one fashion. However, if variable member 170 is grounded or held fixed to the surrounding environment (along with ground member 180), driver discs 124 and 126, and likewise output rings 142 and 144, and output surface 160 all rotate with increased torque. This torque increase begins as rings 154 are held rotationally fixed. In such case, driver disc 126 is only free to rotate within the radius of ring 154. As such, as eccentric lobes 114 and 116 sweep around the circumference of central component 112, driver discs 124 and 126 sweep out eccentric rings, alternatingly engaging output rings 142 and 144. This "reduction" goes hand in hand with the torque increase transferred to output surface 160 and shaft member 16. Finally, any number of methods may be used to vary the rotational speed of variable member 170, the most probable methods include use of a standard clutch.

Ground member 180 is engaged with variable member 170, on the opposite side from drivers discs 124 and 126. In the preferred embodiment, ground member 180 is primarily responsible for securing member 14 with respect to its surrounding environment. Ground member 180 is engaged with central component 112 through bearings 184, and is engaged with variable member 170 through bearings 182. Configuration of bearings 182 and 184 allow central component 112 and variable member 170 to freely rotate with respect to ground member 180. By virtue of its novel arrangement, specifically its actual configuration and placement in relation other components, member 14 provides for an extremely efficient means of reducing rotational speed and increasing torque in a very compact framework. Further, the ability of member 14 to withstand shock loads and change between forward and reverse operating modes makes it ideal for use recovering oil.

Figure 2:
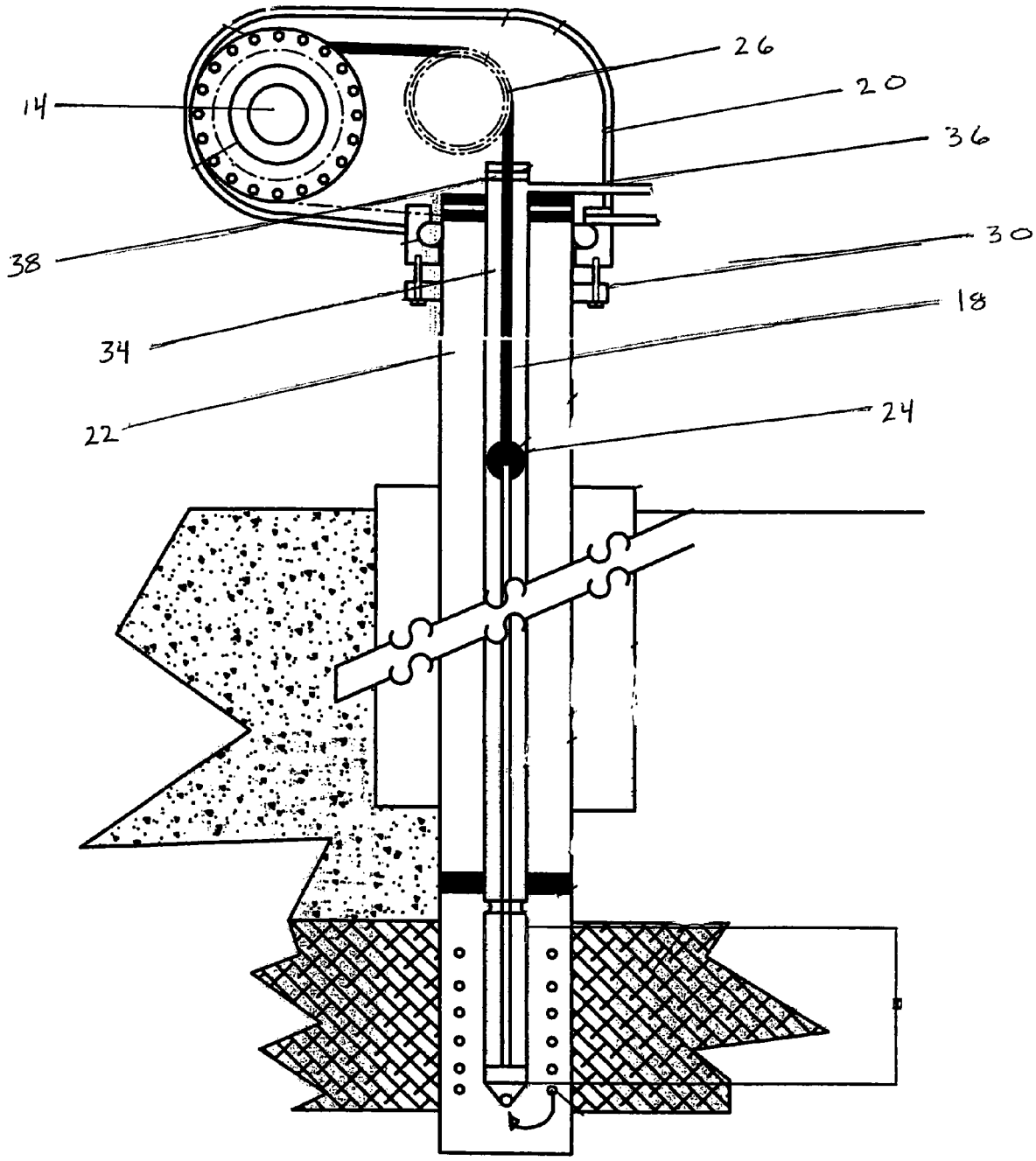
FIG. 2 is side plan view of the system of the preferred embodiment of the present invention.
Figure 3:
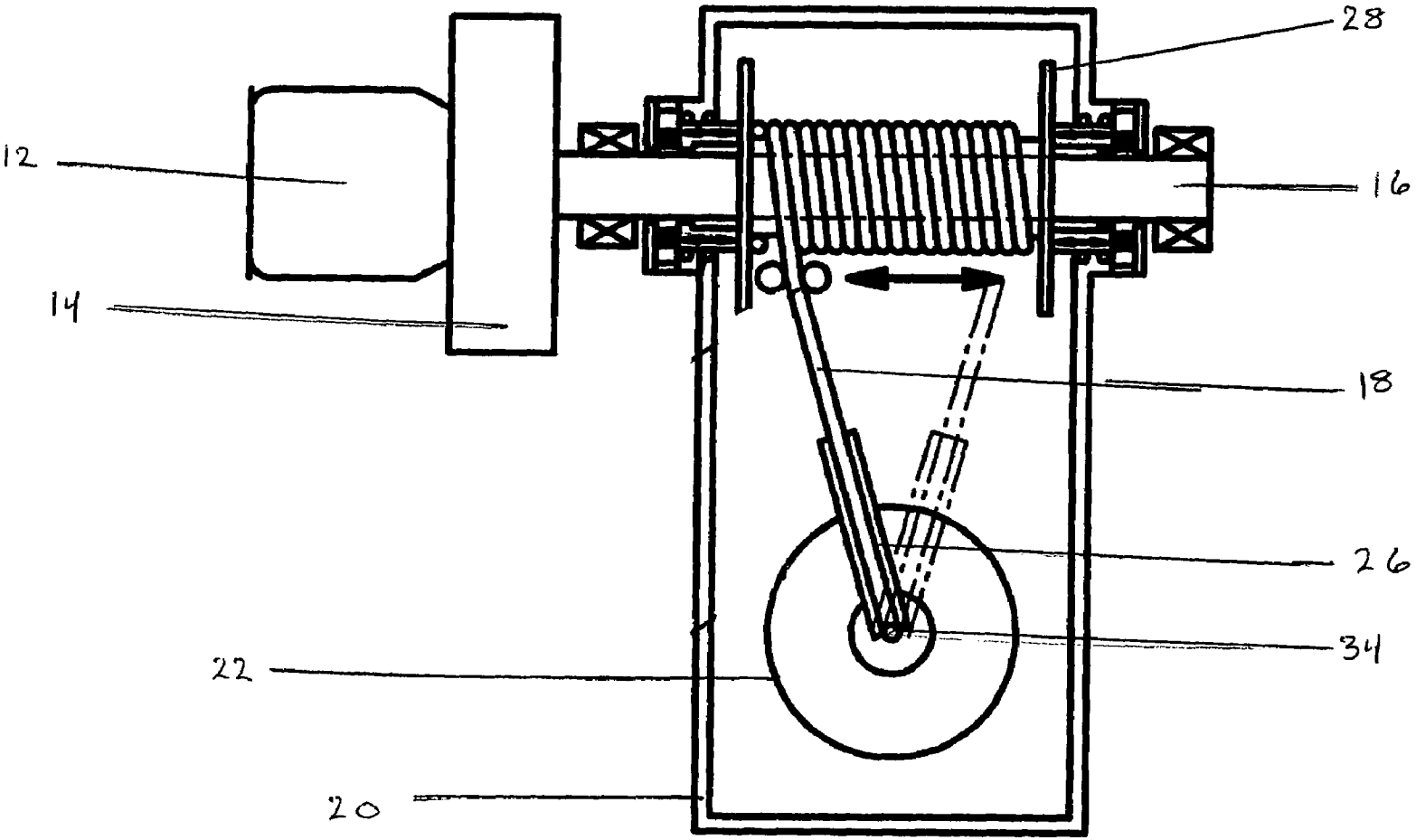
FIG. 3 is top plan view of the system of the preferred embodiment of the present invention.

Referring to FIGS. 1, 2, and 3 shaft member 16 extends from torque variation member 14 where it maintains spooled cable 18. Cable 18 could be any one of several types of cable known in the oil recovery industry. However, in the preferred embodiment, cable member 18 is of a general ribbon shape and is comprised of KEVLAR or some composite thereof, or some material of suitably strong, yet easily-spooled material. Cable 18 is preferably comprised of such material to release and wind about shaft member 16 more easily and lay flat when spooled about shaft member 16.

Cable 18 extends between shaft member 16 and a down-hole location within annulus 22 where it is engaged with a pumping means as known in the art, such as a sucker rod. During operation, variable rotation (i.e., alternating between a forward and reverse mode) of motor 12, torque variation member 14, and shaft 16 actuates cable 18 between a retracted position and an extended position. Actuation of cable 18 between each position causes corresponding lifting and lowering of the pump device located along the down-hole portion of the oil well. Cable 18 is maintained along shaft 16 between drums 28, which serve to keep cable 18 properly aligned as cable 18 repeatedly winds around and releases from shaft 16.

Centering ball 24 is located along some intermediate portion within annulus 22. Centering ball 24 has a central aperture of sufficient dimension to allow cable 18 to pass through. Centering ball 24 serves to centrally align cable 18 within annulus 22 such that cable 18 may actuate between its retracted and extended position without coming into contact with annulus 22. As such, system 10 avoids any sliding friction associated with a production cable moving against a production annulus. Also in the preferred embodiment, centering wheel 26 (preferably having the general contour of a tubing sheath) is located between the motor 12 and torque variation member 14 combination and annulus 22 where its outer radial edge is aligned with the center of annulus 22. Centering wheel 26 also serves to centrally align cable 18 with annulus 22. By virtue of "running along" wheel 26, cable 18 is "guided" towards the center of annulus 22 so that cable 18 and annulus 22 have no contact as cable 18 extends between its vertical arrangement within annulus 22 and its spooled arrangement around shaft 16. Other useful embodiments are envisioned where the radial edge of shaft 16 is substantially aligned with the center of annulus 22 thereby eliminating the necessity of wheel 26. Employment of centering ball 24 and centering wheel 26, alone and in combination with one another, further eliminates sliding part friction. Consequently, one does not have to look hard to see the increase in mechanical efficiency such an arrangement provides.

Referring to FIG. 1, housing body 20 substantially surrounds member 16, preferably in fluid-tight fashion. This arrangement is preferred especially in the event that device 10 is placed below surface level. Device 10 may continue to operate in the event recovered oil rises into the housing as shaft member 16 is actuated between its first and second operating mode. The seal between shaft member 16 and housing body 20 may be comprised of a sealing means 32 as known in the art (i.e., a fitted o-ring, gasket, or metal-to-metal). Housing body 20, in the preferred embodiment, can be secureably engaged with annulus 22. This can be accomplished as housing body 20 may have a collar 30 configured to fit upon, and engage with, annulus 22.

Further, in the preferred embodiment, production tube 34 may be fitted with outlet 36 and/or seal 38. Preferably, outlet 36 is flexible in nature and is in direct fluid communication with production tubing 34. During operation, recovered oil may flow through production tube 34 and outlet 36 to any number of recovery, storage, or processing means. Seal 38, in the preferred embodiment, is fitted about the top portion of production tube 34 and surrounds cable 18 so as to prevent recovered oil from flowing into housing body 20. Finally, seal 38 is not essential to operation as recovered oil may flow within housing body 20 during operation, or, may be prevented from doing so by seal 38.

Efficient operation of the present system is bolstered by a management means put in place to control operation of the system and measure produced oil. That is, in the preferred embodiment, controller means 40 serves to evaluate the operation of system 10 against a series of selected operational parameters. Preferably, although not exclusively, controller means 40 would work from differential amps to motor 12. In this fashion, motor 12 may start on a preset "slow power" setting and gradually ramp up to desired production parameters. Likewise, pump stroke length and pump stroke speed can be changed simply by adjusting motor speed and the duration of each operating mode. As the fluid level descends in the well bore, additional power may be necessary to produce the same volume of fluid Necessary power (probably measured in amps load) should correlate to producing fluid level and producing volumes. Finally, production volumes can be measured by measurement mean 42. Measurement means 42 may be comprised of several types of flow meters as known in the art, such as a differential flow meter produced by companies such as HALIBURTON and EDI. General operation of the preferred embodiment involves information received at measurement means 42 being sent to controller means 40. Controller means 40 may then carry out any number of functions (i.e., evaluate, compare, and record production volume and other parameters; adjust operation of hydraulic fluid circulating means 44) to better manage the operation of the system 10.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A fluid recovery system, comprising:

a drive member, said drive member configured for variable operation;

a torque variation member, said torque variation member being comprised of:

an input member configured to receive and engage said drive member;

a driver disc, said driver disc configured to move about said input member in eccentric fashion, responding to rotational force applied to said input member by said drive member;

an output component, said output component being configured to rotate about said driver disc and said input component; and an engagement means located along the periphery of said driver disc such that said engagement means alternatingly engages said output component; and a pumping means, said pumping means configured in mechanical communication with said torque variation member for actuation by said torque variation member, said pumping means being configured for placement in fluid communication with a subterranean fluid source for conveyance of fluid from said subterranean fluid source to a substantially surface elevation.

2. The fluid recovery system of claim 1 wherein said drive member and said torque variation member being configured for operation in first and second opposing modes whereby, when said drive member and said torque variation member are changed from one of said modes to the other said mode, said drive member and said torque variation member change operational directions.

3. The fluid recovery system of claim 1 further comprising:

a system management means comprising:

a measurement means configured for measuring an amount of pumped fluid; and a control means configured for controlling operational characteristics of said fluid recovery system.

4. The fluid recovery system of claim 2 further comprising:

a system management means comprising:

a measurement means configured for measuring an amount of pumped fluid; and a control means configured for controlling operational characteristics of said fluid recovery system.

* * * * *

UNITED STATES PATENT AND TRADEMARK OFFICE

CERTIFICATE OF CORRECTION

PATENT NO. : 7,448,443 B2
APPLICATION NO. : 11/284798
DATED : November 11, 2008
INVENTOR(S) : Dan Jones et al.

It is certified that error appears in the above-identified patent and that said Letters Patent is hereby corrected as shown below:

On the Title page:

Item 75, Inventors names (left hand column), delete the portion of text reading "Devane Clark" and replace with --Devane Clarke--.

In the specification:

Column 5, Line 62, delete the portion of text reading "central shaft" and replace with --central component--.

Column 6, Line 43, delete the portion of text reading "148" and replace with --146--.

Signed and Sealed this

Thirtieth Day of December, 2008

JON W. DUDAS
*Director of the United States Patent and Trademark Office*